US007314323B2

(12) United States Patent
Kawaguchi

(10) Patent No.: US 7,314,323 B2
(45) Date of Patent: *Jan. 1, 2008

(54) WIRE DOT PRINTER HEAD AND WIRE DOT PRINTER

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/655,281

(22) Filed: Sep. 3, 2003

(65) Prior Publication Data

US 2005/0058488 A1 Mar. 17, 2005

(51) Int. Cl.
*B41J 2/275* (2006.01)

(52) U.S. Cl. ..... 400/124.23; 400/124.11; 400/124.17

(58) Field of Classification Search ..... 400/124.23, 400/124.11, 124.2, 124.12, 124.18
See application file for complete search history.

(56) References Cited

U.S. PATENT DOCUMENTS 3,804,224 A 4/1974 Barnaby et al.
4,537,520 A 8/1985 Ochiai et al.
4,552,064 A * 11/1985 Sanders, Jr. et al. ..... 101/93.05
4,674,896 A 6/1987 Yasunaga et al.
4,697,939 A 10/1987 Ara
4,723,854 A 2/1988 Sakaida et al.
4,767,227 A 8/1988 Mitsuishi et al.
4,802,776 A 2/1989 Miyazawa et al.
4,820,065 A 4/1989 Koyama et al.
4,881,832 A 11/1989 Mitsuishi et al.
4,962,876 A 10/1990 Andou et al.
4,976,554 A 12/1990 Shimosato et al.
4,988,223 A * 1/1991 Hilkenmeier et al. .. 400/124.23
4,993,854 A * 2/1991 Sato ..... 400/124.23
5,063,116 A * 11/1991 Uchida ..... 428/606
5,074,687 A 12/1991 Gugel
5,137,377 A 8/1992 Ito et al.
5,205,659 A 4/1993 Gugel et al.
5,290,112 A 3/1994 Stempfle et al.
5,674,014 A 10/1997 Jordan (Continued)

FOREIGN PATENT DOCUMENTS

JP 60-124262 A 7/1985

(Continued)

OTHER PUBLICATIONS

Machine translation of JP 2001253102 to Asada from Japanese Patent Office website.*

(Continued)

*Primary Examiner*—Daniel J. Colilla
(74) *Attorney, Agent, or Firm*—Frishauf, Holtz, Goodman & Chick, P.C.

(57) ABSTRACT

A wire dot printer head which has an armature spacer having plural notches accommodating support shafts of plural armatures respectively supporting a printing wire, and an abrasion preventive member provided between the armature spacer and a yoke holding the support shafts of the plural armatures with the armature spacer for prevention of contact between the support shafts of the plural armatures and the yoke. As the support shafts of the armatures, protected by the abrasion preventive member, are not in direct contact with the yoke, abrasion of the surface of the yoke can be suppressed, and degradation of printing quality can be prevented.

19 Claims, 7 Drawing Sheets

U.S. PATENT DOCUMENTS

| | | | |
|---|---|---|---|
| 5,975,776 | A | 11/1999 | Groenke |
| 6,513,997 | B2 | 2/2003 | Terao |
| 6,682,233 | B2 | 1/2004 | Terao et al. |
| 6,698,956 | B1 | 3/2004 | Terao |
| 6,776,545 | B1 | 8/2004 | Terao |
| 6,805,503 | B1 | 10/2004 | Tsuchiya et al. |
| 6,848,843 | B1 | 2/2005 | Kawaguchi |
| 6,872,016 | B2 | 3/2005 | Kawaguchi |
| 6,994,482 | B2 | 2/2006 | Terao et al. |
| 7,008,126 | B2 | 3/2006 | Kawaguchi |
| 7,018,116 | B2 | 3/2006 | Tsuchiya et al. |
| 7,020,023 | B2 | 3/2006 | Kuramori |
| 7,048,455 | B2 | 5/2006 | Kawaguchi et al. |
| 2003/0175063 | A1 | 9/2003 | Terao et al. |
| 2005/0160576 | A1 | 7/2005 | Kawaguchi |
| 2005/0201797 | A1 | 9/2005 | Kawaguchi et al. |
| 2005/0201800 | A1 | 9/2005 | Tsuchiya et al. |
| 2005/0201801 | A1 | 9/2005 | Kawaguchi et al. |
| 2005/0207814 | A1 | 9/2005 | Kawaguchi |
| 2005/0207815 | A1 | 9/2005 | Terao et al. |
| 2005/0214052 | A1 | 9/2005 | Kawaguchi et al. |
| 2006/0029449 | A1 | 2/2006 | Kawaguchi |
| 2006/0104696 | A1 | 5/2006 | Kawaguchi |

FOREIGN PATENT DOCUMENTS

| | | | |
|---|---|---|---|
| JP | 62-101458 | A | 5/1987 |
| JP | 02-011336 | A | 1/1990 |
| JP | 7-22994 | B2 | 2/1990 |
| JP | 3-007351 | A | 1/1991 |
| JP | 3-39256 | A | 2/1991 |
| JP | 03-191036 | A | 8/1991 |
| JP | 3-288660 | A | 12/1991 |
| JP | 4-002639 | A | 1/1992 |
| JP | 4-31061 | A | 2/1992 |
| JP | 04-105945 | A | 4/1992 |
| JP | 5-35288 | U | 5/1993 |
| JP | 6-218954 | A | 8/1994 |
| JP | 6-227000 | A | 8/1994 |
| JP | 07-125265 | A | 5/1995 |
| JP | 09-187972 | A | 7/1997 |
| JP | 09-314868 | A | 12/1997 |
| JP | 10-006537 | A | 1/1998 |
| JP | 2833001 | B2 | 10/1998 |
| JP | 10-291330 | A | 11/1998 |
| JP | 2850673 | B2 | 11/1998 |
| JP | 11-78075 | A | 3/1999 |
| JP | 2944562 | A | 6/1999 |
| JP | 11-291524 | A | 10/1999 |
| JP | 2000-280497 | A | 10/2000 |
| JP | 2001-219586 | A | 8/2001 |
| JP | 2001253102 | A * | 9/2001 |

OTHER PUBLICATIONS

U.S. Pat. Appl. No. 10/375,476, filed Feb. 28, 2003, entitled "An Impact Dot Print Head and a Printer Including the Same"; Inventor:.

U.S. Appl. No. 10/655,894, Inventor: Kawaguchi,T., filed Sep. 4, 2003.

U.S. Appl. No. 10/764,642, Inventor: Kawaguchi,T., filed Jan. 26, 2004.

U.S. Appl. No.: 10/940,361, Inventor: Kawaguchi,T. et al., filed Sep. 14, 2004.

U.S. Appl. No.: 10/940,362, Inventor: Kawaguchi,T. et al., filed Sep. 14, 2004.

U.S. Appl. No.: 10/940,492, Inventor: Tsuchiya, K. et al., filed Sep. 14, 2004.

U.S. Appl. No. 10/940,432, Inventor: Kawaguchi,T., filed Sep. 14, 2004.

U.S. Appl. No. 10/940,338, Inventor: Kawaguchi,T. et al., filed Sep. 14, 2004.

U.S. Appl. No. 11/073,118, Inventor: Kawaguchi et al., filed Mar. 3, 2005.

U.S. Appl. No. 11/073,117, Inventor: Tsuchiya et al., filed Mar. 3, 2005.

U.S. Appl. No. 11/073,092, Inventor: Kawaguchi et al., filed Mar. 3, 2005.

U.S. Appl. No. 11/073,093, Inventor: Kawaguchi et al., filed Mar. 3, 2005.

* cited by examiner

WIRE DOT PRINTER HEAD AND WIRE DOT PRINTER

BACKGROUND OF THE INVENTION

1. Field of the Invention

The present invention relates to wire dot printer head and wire dot printer.

2. Discussion of the Background

A wire dot printer head performs printing by oscillation of an armature connected to a printing wire between a printing position and a standby position, and when the armature oscillates to the printing position, colliding an end of the wire with a print medium such as a print sheet.

In such wire dot printer heads, known is a printer head which performs printing by generating a magnetic circuit to attract the armature from the standby position to the printing position by a magnetic flux generated around the armature by a coil (See Japanese Published Unexamined Patent Application No. 2001-219586). As shown in FIGS. 6 and 7, in such wire dot printer head 100, an armature 102 supporting a printing wire 101 has a support shaft 103, and the armature is rotatable about the support shaft 103. An armature spacer 105 having a notch 104 accommodating the support shaft 103 of the armature 102 is provided on a yoke 106 to generate a magnetic circuit.

Further, a plate 108 to hold the support shaft 103 to regulate movement of the support shaft 103 is provided on the armature spacer 105 via an elastic spacer 107 to fix the position of the support shaft 103 of the armature 102 by an elastic force. By this arrangement, abrasion of the plate 108 by the support shaft 103 of the armature 102 can be prevented, and the position of the support shaft 103 is fixed.

However, in accordance with recent increment in printing speed, the armature 102 oscillates between the printing position and the standby position, e.g., 2500 times/second, which causes severe vibration during printing, and the support shaft 103 as the rotational center of the armature 102 abrades the surface of the yoke 106.

When the abrasion of the surface of the yoke 106 by the support shaft 103 of the armature 102 progresses, the support shaft 103 of the armature 102 is movable and is shifted from the predetermined position, thus the oscillation of the armature 102 becomes unstable. This degrades the printing quality. Further, when the abrasion on the surface of the yoke 106 progresses, the armature 102 comes into contact with a coil flange, or the support shaft 103 is slightly moved to scrape the notch 104 of the armature spacer 105. This shortens the life of the wire dot printer head 100.

SUMMARY OF THE INVENTION

Accordingly, the present invention has its object to provide wire dot printer head and wire dot printer which suppress abrasion of the surface of a yoke and prevent degradation of printing quality.

According to one aspect of the present invention, the foregoing object is attained by providing novel wire dot printer head and wire dot printer of the present invention.

According to the novel wire dot printer head and wire dot printer, an abrasion preventive member for prevention of contact between support shafts of plural armatures and a yoke is provided between an armature spacer having plural notches accommodating the support shafts of the plural armatures respectively supporting a printing wire and the yoke holding the support shafts of the armatures with the armature spacer. Due to this construction, the support shafts of the armatures and the surface of the yoke are prevented from direct contact with each other. Further, as the abrasion preventive member is provided on an upper surface of the yoke, a magnetic circuit can be formed in a minimum length.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A preferred embodiment of the present invention will now be described with FIGS. 1 to 5.

Figure 1:
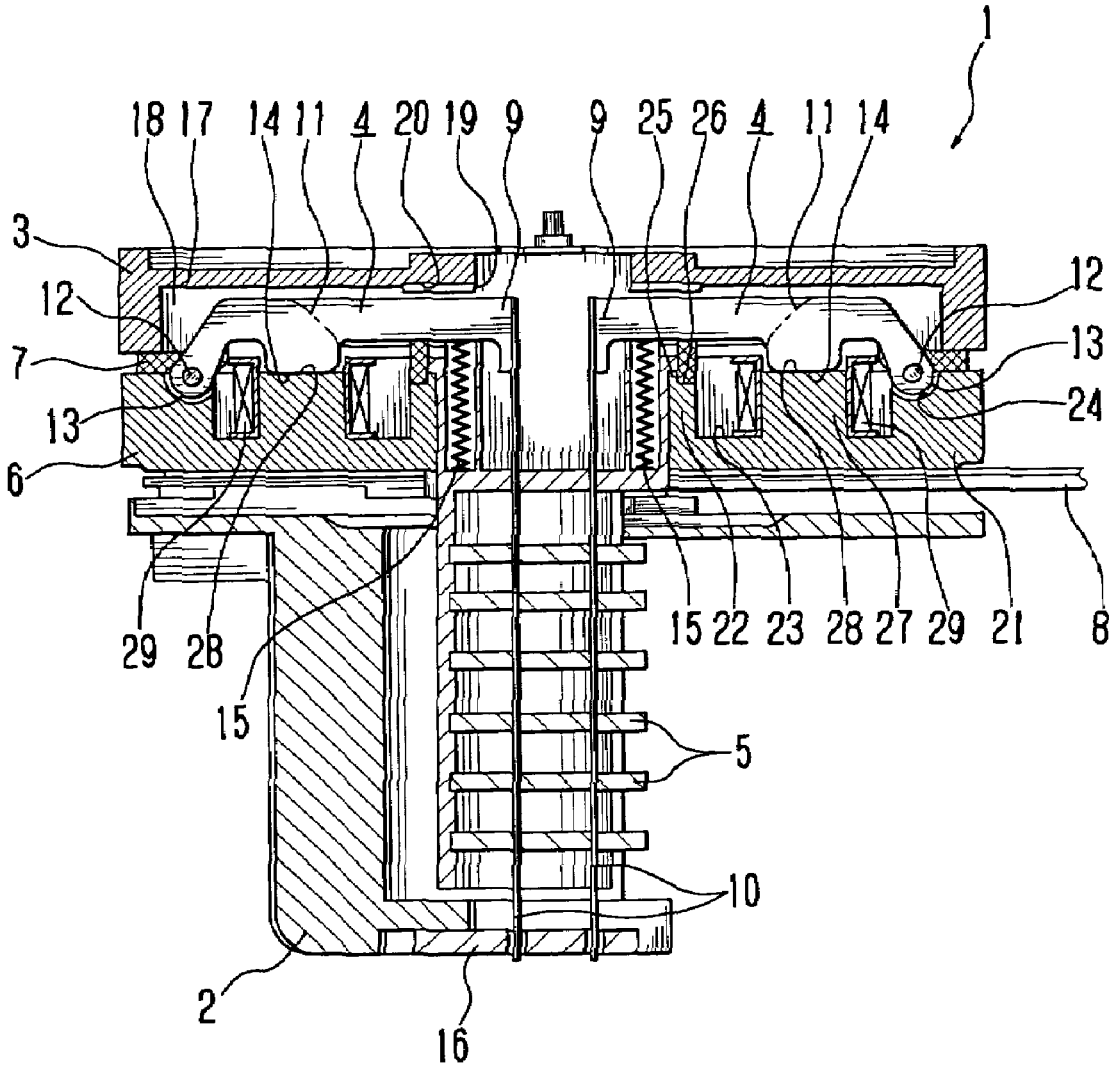
FIG. 1 is a front cross-sectional view schematically showing a wire dot printer head according to an embodiment of the present invention.
Figure 2:
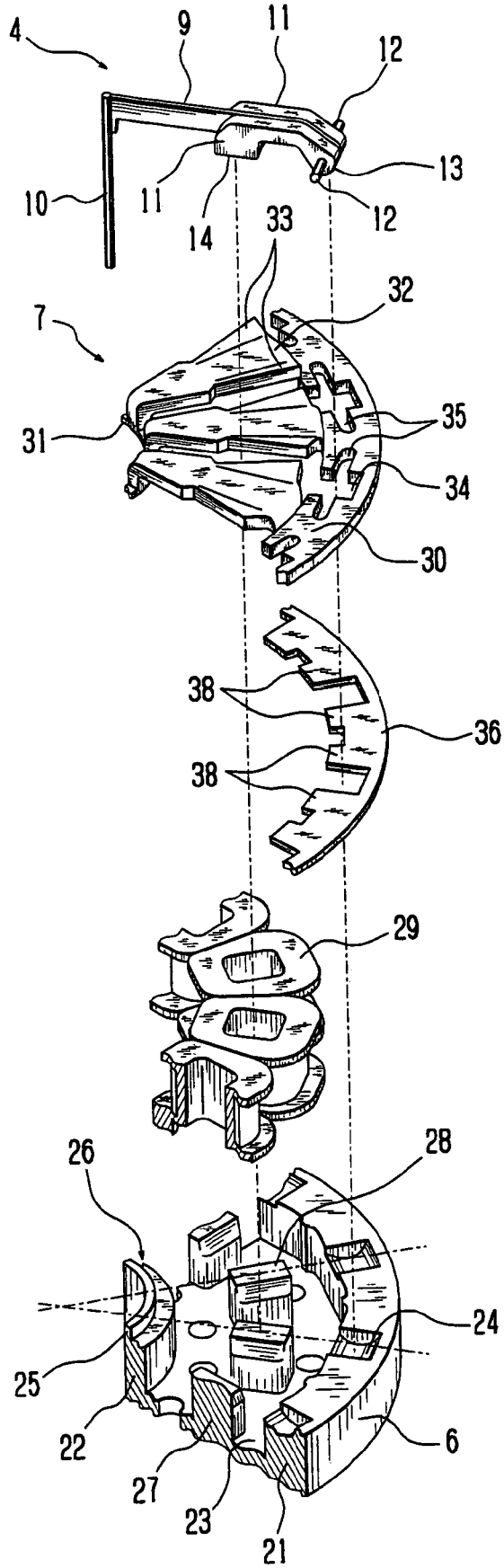
FIG. 2 is an exploded perspective view schematically showing a part of the wire dot printer head according to the embodiment of the present invention.
Figure 3:
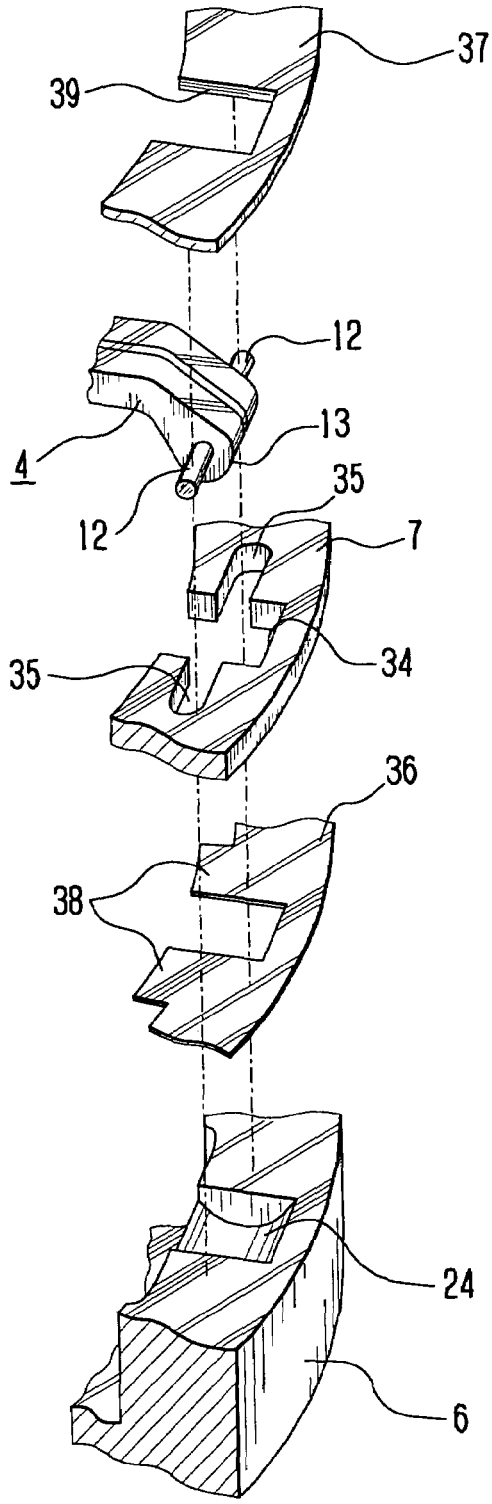
FIG. 3 is an exploded perspective view schematically showing a part of the wire dot printer head according to the embodiment of the present invention.
Figure 4:
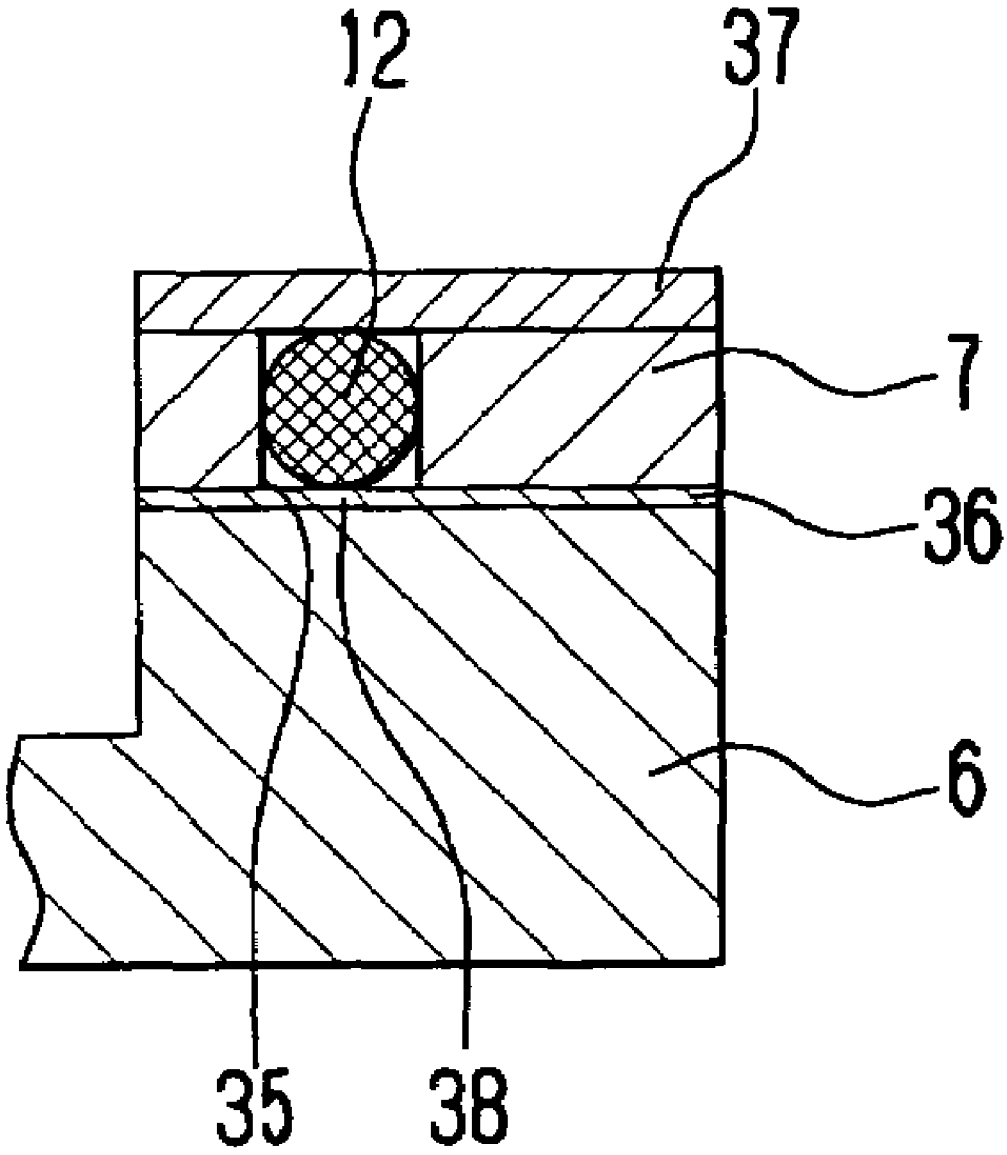
FIG. 4 is side cross-sectional view schematically showing a part of the wire dot printer head according to the embodiment of the present invention.

First, the overall structure of a wire dot printer head will be described with reference to FIGS. 1 to 4. FIG. 1 is a front cross-sectional view schematically showing a wire dot printer head according to the present embodiment. FIGS. 2 and 3 are exploded perspective views schematically showing a part of the wire dot printer head. FIG. 4 is an side cross-sectional view schematically showing a part of the wire dot printer head.

A wire dot printer head 1 has a front case 2 and a rear case 3 connected with an attachment screw (not shown), and armatures 4, wire guides 5, a yoke 6, an armature spacer 7, a circuit board 8 and the like are provided therebetween.

The armature 4 has an arm 9, a printing wire (hereinbelow, simply referred to as a "wire") 10 wax-bonded to an end side of the arm 9 in its lengthwise direction, a magnetic circuit formation member 11 welded to both side surfaces of the arm 9 in its widthwise direction, and a support shaft 12. Further, a rounded part 13 is formed on another end side of the armature 4. The magnetic circuit formation member 11 has an attracted surface 14 positioned in a central portion of the armature 4 in its lengthwise direction.

Plural armatures 4 are provided in a radial pattern to the axel center of the yoke 6. The armatures 4 are supported on the surface of the yoke 6, respectively rotatably about the support shafts 12 in a direction away from the yoke 6, and pressed in the direction away from the yoke 6 by a pressing member 15.

When the armature 4 oscillates to a printing position, an end of the wire 10 moves in accordance with the oscillation of the armature 4 to a predetermined position to collide with a print medium such as a print sheet.

The wire guide 5 slidably guides the wire 10 such that the end of the wire 10 collides with a predetermined position of the print medium. Further, the front case 2 has an end guide 16 to array the ends of the wires 10 in a predetermined pattern and to slidably guide the wires 10.

The rear case 3 has a cylindrical member 18 having a bottom surface 17 on one end side. Further, an attachment recess portion 20 to which a metal ring armature stopper 19 is attached is formed in the central portion of the bottom surface 17. The armature stopper 19 is fitted into the attachment recess portion 20.

When the armature 4 oscillates from the printing position by the pressing member 15, the arm 9 as a part of the armature 4 comes into contact with the armature stopper 19, thereby the oscillation of the armature 4 is stopped. Accordingly, the armature stopper 19 has a function to determine the standby position of the armature 4.

The circuit board 8 has a circuit to control the oscillation of the armature 4 between the printing position and the standby position. Upon printing operation, an arbitrary armature 4 can be selectively moved under the control of the circuit board 8.

The yoke 6, formed of a magnetic material, has a pair of cocentrically-provided cylindrical members 21 and 22 having different diameters. The lengths of the cylindrical members 21 and 22 in the axial direction (up-and-down directions in FIG. 1, hereinbelow, axial direction of the yoke 6) are equal to each other. The outer peripheral side cylindrical member 21 and the inner peripheral side cylindrical member 22 are integrated with a bottom surface 23 provided to cover one end in the axial direction.

Note that in the present embodiment, the yoke 6 is manufactured by the Lost Wax method using PMD. The surface hardness of the yoke 6 is about Hv 330. The surface of the yoke 6 is polished, thereby predetermined values of the flatness and surface roughness are ensured.

The outer peripheral cylindrical member 21 has plural cavities 24. These cavities 24 respectively have an inner surface of a recess shape with an approximately the same curvature radius as that of the outer peripheral surface of the rounded part 13 of the armature 4. The number of the cavities 24 is the same as that of the armatures 4. The rounded parts 13 formed on one end side of the armatures 4 are slidably fit into the respective cavities 24.

The inner peripheral side cylindrical member 22 is provided with a ring-shaped engagement member 25. The engagement member 25 is integrally formed with the inner peripheral side cylindrical member 22 such that the position of the engagement member is cocentric with the cylindrical member 22. The outer diameter of the engagement member 25 is smaller than that of the inner peripheral side cylindrical member 22. Accordingly, a step portion 26 is formed with the engagement member 25 in the inner peripheral side cylindrical member 22.

The bottom surface 23 is integrally provided with plural cores 27 circularly arranged between the outer peripheral side cylindrical member 21 and the inner peripheral side cylindrical member 22. The length of the respective cores 27 in the axial direction of the yoke 6 is equal to that of the cylindrical members 21 and 22 in the axial direction of the yoke 6.

In the respective cores 27, magnetic pole surfaces 28 are formed at one end in the axial direction of the yoke 6. The magnetic pole surface 28 of the core 27 is opposite to the attracted surface 14 of the magnetic circuit formation member 11 provided in the armature 4. Further, coils 29 are respectively wound around the periphery of the respective cores 27. That is, the yoke 6 has circularly provided plural cores 27 with coils 29.

The yoke 6 is held between the front case 2 and the rear case 3 in a statues where its open side opposite to the bottom surface 23 is opposed to the open end of the rear case 3. Note that in the present embodiment, all the coils 29 are in the same winding direction, however, the present invention is not limited to this direction. For example, coils in different winding directions may be selectively arranged.

The armature spacer 7 has a pair of ring members 30 and 31 having approximately the same diameters of those of the cylindrical members 21 and 22 of the yoke 6, and plural guide members 32 provided between the ring members 30 and 31 in a radial pattern and positioned among the armatures 4. The outer peripheral side ring member 30 and the inner peripheral side ring member 31 are cocentric with each other. The outer peripheral side ring member 30, the inner peripheral side ring member 31 and the guide members 32 are integrally formed with each other.

When the armature spacer 7 is provided on the yoke 6, the outer peripheral side ring member 30 and the inner peripheral side ring member 31 respectively come into contact with the cylindrical members 21 and 22 of the yoke 6, and the inner peripheral side ring member 31 is engaged with the engagement member 25. Note that the inner diameter of the inner peripheral side ring member 31 is equal to or slightly larger than the outer diameter of the engagement member 25.

The respective guide members 32 have side yokes 33 extending in a diagonal direction away from the magnetic pole surface 28 of the core 27 along an approximate radial direction of the ring members 30 and 31. The side yoke 33 has a wing-like shape gradually expands from the inner peripheral side ring member 31 toward the outer peripheral side ring member 30.

In the armature spacer 7, as the plural guide members 32 are provided between the pair of ring members 30 and 31, slit guide grooves 34 are ensured along a radial direction of the ring members 30 and 31. The respective guide grooves 34 have a width so as to allow the respective guide members 32 to be positioned in the proximity of the magnetic circuit formation member 11 within a range not to disturb oscillation of the armature 4.

Further, the guide groove 34 is connected to the outer peripheral side ring member 30, and the guide groove 34 in the outer peripheral side ring member 30 has a bearing groove 35 as a notch connected with the guide groove 34 in a position on both sides of the guide groove 34 along the outer diameter direction of the ring member 30. The support shaft 12 of the armature 4 is engaged with the bearing groove 35. That is, the support shaft 12 of the armature 4 is held with the yoke 6 and the armature spacer 7 such that the plural armatures 4 are opposite to the plural cores 27.

An abrasion preventive member 36 for prevention of contact between the support shafts 12 of the plural armatures 4 and the yoke 6 is provided between the yoke 6 and the armature spacer 7. A pressing member 37 to hold the support shafts 12 of the plural armatures 4 is provided on the armature spacer 7.

The abrasion preventive member 36, having a ring shape not to disturb oscillation of the plural armatures 4, has plural contact preventive members 38 between the yoke 6 and the plural armatures 4. Further, to construct a magnetic path in a minimum distance between the cores 27 and the armatures 4, the abrasion preventive member 36 is formed of a heat-processed SK plate having a thickness of 0.20 mm, and is provided on the yoke 6. Note that the abrasion preventive member 36 is made of a member having high-hardness and excellent abrasion resistance, and having excellent magnetic permeability.

The pressing member 37 holds the support shafts 12 of the plural armatures 4 by coupling of the front case 2 and the rear case 3 with the attachment screw. The pressing member 37 has a ring shape. Further, the pressing member 37 has grooves 39 with a width approximately the same as that of the armature 4, extending in its radial direction, not to disturb the oscillation of the armatures 4.

In the present embodiment, the diameter of the support shaft 12 of the armature 4 is 0.90 mm, and the thickness of the armature spacer 7 in the bearing groove 35 is 0.80 mm. When the support shaft 12 of the armature 4 is fitted into the bearing groove 35, the support shaft 12 protrudes from the bearing groove 35 by 0.10 mm and is contact with the pressing member 37, thereby reliably held.

Figure 5:
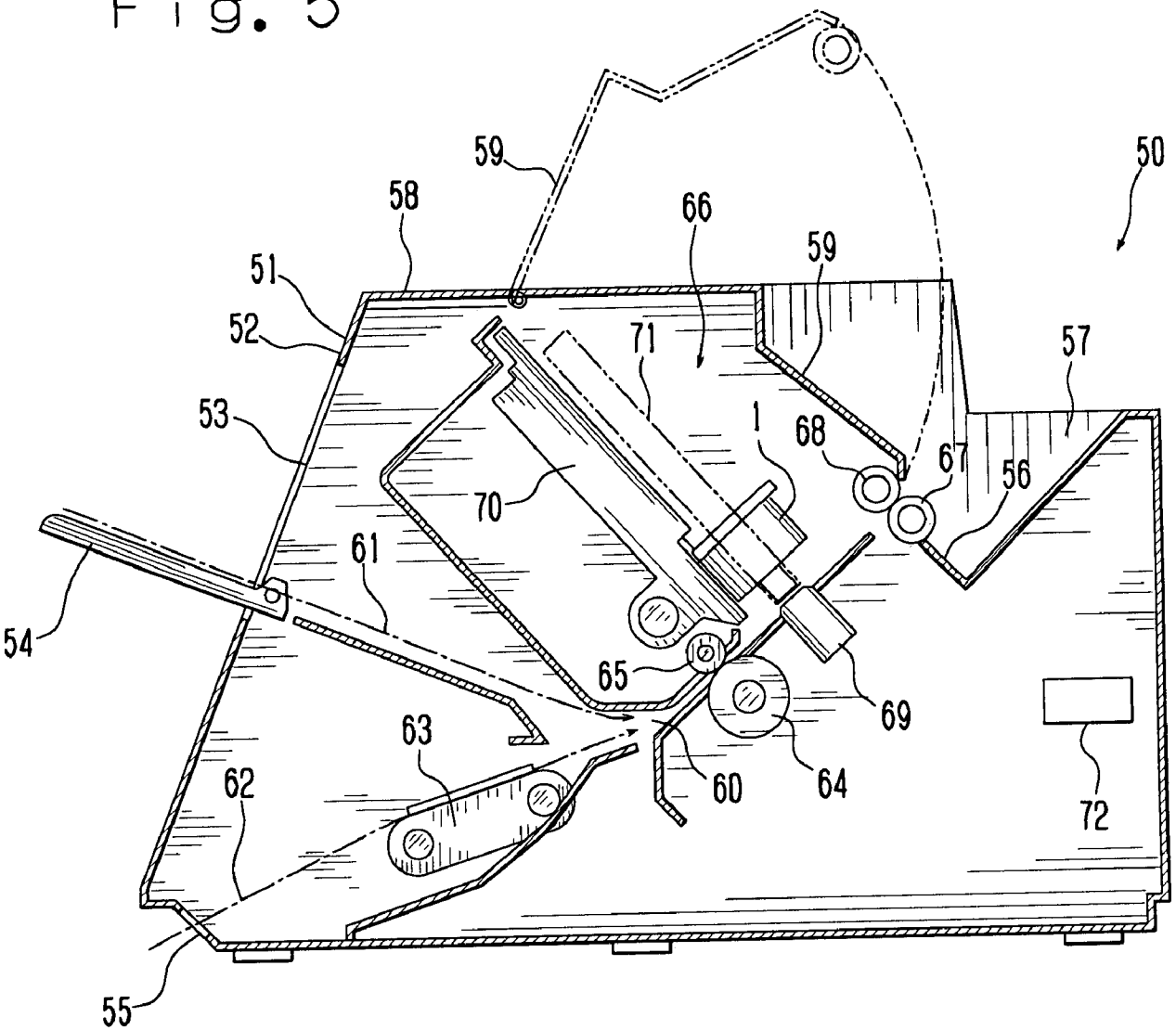
FIG. 5 is a side cross-sectional view schematically showing a wire dot printer according to the embodiment of the present invention.
Figure 6:
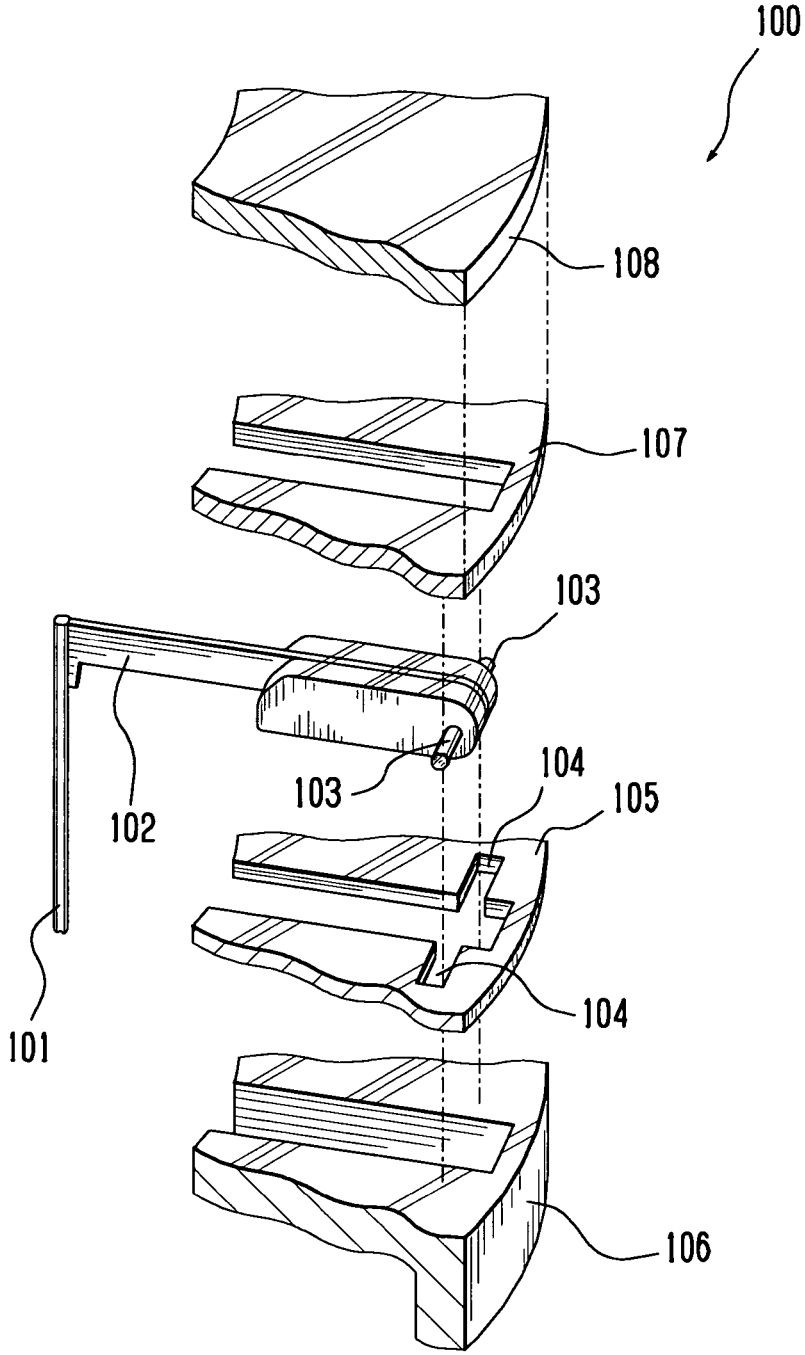
PRIOR ART Fig. 6
FIG. 6 is an exploded perspective view schematically showing a part of the conventional wire dot printer head.
Figure 7:
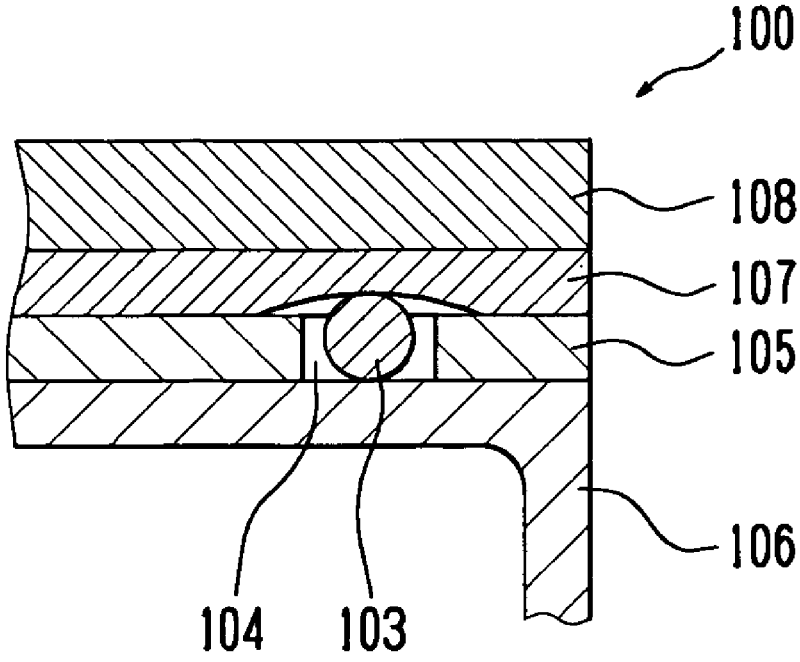
PRIOR ART Fig. 7
FIG. 7 is a side cross-sectional view schematically showing a part of the conventional wire dot printer head.

Next, a wire dot printer having the above-described wire dot printer head 1 will be described with reference to FIG. 5. FIG. 5 is a side cross-sectional view schematically showing the wire dot printer according to the present embodiment.

A wire dot printer 50 has a main body case 51. An opening 53 is formed in a front surface 52 of the main body case 51. A manual paper-feed tray 54 is openably/closably provided in the opening 53. Further, a paper feed port 55 is formed in a lower part on the front surface 52 side of the main body case 51, and a paper discharge stacker 57 is provided on the rear surface 56 side. Further, an opening/closing cover 59 is rotatably provided on an upper surface 58 of the main body case 51. FIG. 1 shows the opened opening/closing cover 59 with a virtual line.

A paper transfer path 60 as a print medium transfer path is provided in the main body case 51. The upstream side of the paper transfer path 60 in a paper transfer direction is connected to a paper feed passage 61 provided on a plane extended from the opened manual paper-feed tray 54 and a paper feed passage 62 connected to the paper feed port 55, and the downstream side in the paper transfer direction is connected to the paper discharge stacker 57. A tractor 63 to transfer paper is provided in the paper feed passage 62.

In the paper transfer path 60, opposed transfer roller 64 and pressing roller 65 are provided, and the pressing roller 65 is pressed against the transfer roller 64. The transfer roller 64 and the pressing roller 65 construct a paper transfer unit as a print medium transfer unit to transfer a print sheet as a print medium. Further, in the paper transfer path 60, a printer unit 66 to perform printing operation on a transferred print sheet is provided, and a paper discharge roller 67 is provided at the entrance of the paper discharge stacker 57. A pressing roller 68 pressed against the paper discharge roller 67 is rotatably supported on the free end side of the opening/closing cover 59.

The printer unit 66 has a platen 69 provided in the paper transfer path 60, a carriage 70 reciprocate-movable in a direction orthogonal to the paper transfer path 60 along the platen 69, the above-described wire dot printer head 1 mounted on the carriage 70, an ink ribbon cassette 71 and the like. Note that the ink ribbon cassette 71 is attachably/removably provided.

The carriage 70 is driven by a motor (not shown), and is reciprocated along the platen 69. The wire dot printer head 1 is reciprocated in accordance with the reciprocating movement of the carriage 70 along the platen 69. In the present embodiment, the carriage 70, the motor and the like realize a head driving mechanism. Further, the wire dot printer 50 includes a driving control unit 72 to control the respective elements in the main body case 51. The driving control unit 72 drives the respective elements such as the printer unit 66, the tractor 63 and the motor.

In this construction, in a case where cut paper is used as a print sheet, it is fed from the manual paper-feed tray 54. In a case where continuous forms are used as print sheets, they are fed from the paper feed port 55. In use of any paper, the paper is transferred by the transfer roller 64, then discharged by the paper discharge roller 67 onto the paper discharge stacker 57, and at this process, subjected to printing by the wire dot printer head 1.

In the wire dot printer head 1, printing is performed by selectively exciting the coils 29, thereby attracting the armatures 4 to the magnetic pole surfaces 28 of the cores 27 and rotating the armatures about the support shafts 12, and then pressing the wires 10 via an ink ribbon (not shown) against the print sheet (not shown) on the platen 69. When electrification to the coils 29 is stopped, the armatures 4 are returned by the pressing force by the pressing member 15 and stopped in the standby position with the armature stopper 19.

More specifically, upon printing operation by the wire dot printer 50, when electrification is performed selectively to the coil 29 based on print data under the control of the driving control unit 72, a magnetic circuit is formed from the core 27 to which the selected coil 29 is attached, via the magnetic circuit formation member 11 of the armature 4 opposite to the core 27, a pair of side yokes 33 opposite to the magnetic circuit formation member 11, the outer peripheral side cylindrical member 21 and the inner peripheral side cylindrical member 22 of the yoke 6, and again from the bottom surface 23 to the core 27.

By the formation of magnetic circuit, an attraction force to attract the magnetic circuit formation member 11 to the magnetic surface 28 of the core 27 occurs between the attracted surface 14 of the magnetic circuit formation member 11 and the magnetic pole surface 28 of the core 27. By this attraction force the armature 4 oscillates about the support shaft 12 in a direction where the attracted surface 14 of the magnetic circuit formation member 11 is attracted to the magnetic surface 28 of the core 27. Note that in the present embodiment, the position in which the attracted surface 14 of the magnetic circuit formation member 11 of the armature 4 comes into contact with the magnetic surface 28 of the core 27 is the printing position.

As the armature 4 oscillates to the printing position, the end of the wire 10 collides with the print sheet side. In the present embodiment, as the ink ribbon (not shown) exists between the wire dot printer head 1 and the print sheet, the pressing force of the wire 10 is transmitted via the ink ribbon to the print sheet, thereby ink of the ink ribbon is transferred to the print sheet. Thus printing is performed.

When the electrification to the coil 29 is stopped, as the magnetic flux disappears, the magnetic circuit also disappears. As the attraction force attracting the magnetic circuit formation member 11 to the magnetic pole surface 28 of the core 27 disappears, the armature 4 is moved by the pressing force of the pressing member 15 in a direction away from the yoke 6 and oscillates about the support shaft 12 to the standby position. The armature 4 oscillates toward the standby position, then as the arm 9 comes into contact with the armature stopper 19, the armature stops in the standby position. This printing operation is performed at a high speed.

At this time, the armature 4 oscillates between the printing position and the standby position, e.g., 2500 times/second. As the support shaft 12 of the armature 4, protected by the abrasion preventive member 36, is not direct contact with the yoke 6, abrasion of the surface of the yoke 6 can be suppressed. As a result, the life of the wire dot printer head 1 can be increased, and degradation of printing quality can be prevented.

Further, in the present embodiment, the abrasion preventive member 36 has plural contact preventive members 38 between the yoke 6 and the support shafts 12 of the plural armatures 4, abrasion of the surface of the yoke 6 can be suppressed with a simple construction.

Further, in the present embodiment, as the abrasion preventive member 36 has a ring shape, the oscillation of the armature 4 is not disturbed in this simple construction, and further, the abrasion preventive member 36 can be easily attached/removed.

Further, in the present embodiment, as the abrasion preventive member 36 is formed of a material having excellent magnetic permeability, an excellent magnetic circuit is formed, and a stable oscillation operation of the armature 4 can be realized. Further, as the abrasion preventive member 36 is provided on the upper surface of the yoke 6, an extremely short magnetic circuit can be formed.

Note that in the present embodiment, a print sheet is used as a print medium, however, the present invention is not limited to this medium. For example, pressure-sensitive paper in which color development is caused in a pressurized portion may be employed. In use of the pressure-sensitive paper as a print medium, printing is performed by color development in a portion pressurized by the pressing force of the wire 10 of the wire dot printer head 1.

Obviously, numerous modifications and variations of the present invention are possible in light of the above teachings. It is therefore to be understood that within the scope of appended claims, the invention may be practiced otherwise than as specifically described herein.

What is claimed is:

1. A wire dot printer head comprising:

a plurality of armatures, each of which supports a printing wire and has a support shaft as a rotational center;

a yoke comprising an outer peripheral cylindrical member, an inner peripheral cylindrical member, a plurality of cores provided between the outer peripheral cylindrical member and the inner peripheral cylindrical member, and a coil wound around each of the plurality of cores, the yoke supporting the support shafts of the plurality of armatures at the outer peripheral cylindrical member such that each of the plurality of armatures is positioned opposite to a respective one of the plurality of cores; and an abrasion prevention plate provided between the yoke and the plurality of armatures to prevent contact between the support shafts of the plurality of armatures and the yoke;

wherein the abrasion prevention plate is ring shaped and has a substantially constant thickness in an axial direction thereof, the abrasion prevention plate has an outer diameter that is substantially the same as an outer diameter of the outer periphery cylindrical member of the yoke, and the abrasion prevention plate has an inner edge that is disposed outside of the cores in a radial direction of the abrasion prevention plate;

wherein the abrasion prevention plate comprises a plurality of abrasion resistant contact prevention members which are positioned between the yoke and the support shafts of the plurality of armatures; and wherein the abrasion prevention plate has a magnetic permeability such that the abrasion prevention plate forms a part of a magnetic path with the cores, and is shaped so as not to disturb oscillation of the plurality of armatures.

2. A wire dot printer comprising:

the wire dot printer head according to claim 1;

a platen positioned opposite to the wire dot printer head;

a carriage which holds the wire dot printer head, and which is adapted to reciprocate along the platen;

a print medium transfer unit which is adapted to transfer a print medium to a position between the wire dot printer head and the platen; and a driving control unit which is adapted to drive the wire dot printer head, the carriage and the print medium transfer unit based on print data.

3. The wire dot printer head according to claim 1, further comprising an armature spacer which is provided on the yoke, and which includes a plurality of notches accommodating therein the support shafts of the plurality of armatures to hold the support shafts with the yoke, so as to oscillatably hold the plurality of armatures.

4. The wire dot printer head according to claim 3, further comprising a pressing member provided on the armature spacer to press the support shafts of the plurality of armatures, wherein the pressing member is shaped so as not to disturb the oscillation of the plurality of armatures.

5. The wire dot printer head according to claim 3, wherein the armature spacer includes an outer peripheral section, and the plurality of notches are formed in the outer peripheral section.

6. The wire dot printer head according to claim 5, wherein the abrasion prevention plate is thinner than the outer peripheral section of the armature spacer.

7. The wire dot printer head according to claim 1, wherein the abrasion prevention plate is hardened.

8. A wire dot printer head comprising:

a plurality of armatures, each of which supports a printing wire and has a support shaft as a rotational center;

a yoke comprising an outer peripheral cylindrical member having a plurality of recesses provided therein, an inner peripheral cylindrical member, a plurality of cores provided between the outer peripheral cylindrical member and the inner peripheral cylindrical member, and a coil wound around each of the plurality of cores, the yoke supporting the support shafts of the plurality of armatures at the outer peripheral cylindrical member such that each of the plurality of armatures is positioned opposite to a respective one of the plurality of cores; and an abrasion prevention plate provided between the yoke and the plurality of armatures to prevent contact between the support shafts of the plurality of armatures and the yoke;

wherein the abrasion prevention plate comprises a plurality of abrasion resistant contact prevention members which are positioned between the yoke and the support shafts of the plurality of armatures;

wherein the abrasion prevention plate has an excellent magnetic permeability such that the abrasion prevention plate forms a part of a magnetic path with the cores, and is shaped so as not to disturb oscillation of the plurality of armatures;

wherein each of the armatures includes an arc-shaped portion that slidably fits into a corresponding one of the plurality of recesses in the outer peripheral cylindrical member of the yoke; and wherein the plurality of recesses include respective inner peripheral faces having a concave shape with a curvature radius approximately equal to a curvature radius of an outer peripheral face of the arc-shaped portions of the armatures.

9. A wire dot printer head comprising:

a plurality of armatures, each of which supports a printing wire and has an outer section with a rotational center;

a yoke comprising an outer peripheral cylindrical member, an inner peripheral cylindrical member, a plurality of cores provided between the outer peripheral cylindrical member and the inner peripheral cylindrical member, and a coil wound around each of the cores, wherein the yoke provides support to the armatures at the outer peripheral cylindrical member and each of the plurality of armatures is positioned opposite to a respective one of the plurality of cores; and an abrasion prevention plate which is ring shaped and positioned between the yoke and the plurality of armatures along an axial direction of the abrasion prevention plate to prevent contact between at least a portion of the outer section of each of the plurality of armatures and the yoke;

wherein the abrasion prevention plate is substantially flat in the axial direction thereof, has an outer diameter that is substantially the same as an outer diameter of the outer periphery cylindrical member of the yoke, and has an inner edge that is disposed outside of the cores in a radial direction of the abrasion prevention plate; and wherein the abrasion prevention plate has a magnetic permeability such that the abrasion prevention plate forms a part of a magnetic path with the cores.

10. A wire dot printer comprising:

the wire dot printer head according to claim 9;

a platen positioned opposite to the wire dot printer head;

a carriage which holds the wire dot printer head, and which is adapted to reciprocate along the platen;

a print medium transfer unit which is adapted to transfer a print medium to a position between the wire dot printer head and the platen; and a driving control unit which is adapted to drive the wire dot printer head, the carriage and the print medium transfer unit based on print data.

11. The wire dot printer head according to claim 9, further comprising an armature spacer which is provided on the yoke, and which includes a plurality of notches accommodating the plurality of armatures so as to oscillatably support the plurality of armatures.

12. The wire dot printer head according to claim 11, further comprising a pressing member positioned above the armatures, wherein the pressing member presses the plurality of armatures and is shaped so as not to disturb oscillation of the plurality of armatures.

13. The wire dot printer head according to claim 11, wherein the armature spacer includes an outer peripheral section, and the plurality of notches are formed in the outer peripheral section.

14. The wire dot printer head according to claim 13, wherein the abrasion prevention plate is thinner than the outer peripheral section of the armature spacer.

15. The wire dot printer head according to claim 9, wherein the abrasion prevention plate is hardened.

16. The wire dot printer head according to claim 9, wherein the abrasion prevention plate has a lower face that abuts flat against an upper surface of the outer peripheral cylindrical member of the yoke.

17. The wire dot printer head according to claim 9, wherein the abrasion prevention plate abuts flat against the outer peripheral cylindrical member of the yoke.

18. The wire dot printer head according to claim 9, wherein the abrasion prevention plate is configured so as not to disturb oscillation of the plurality of armatures.

19. The wire dot printer head according to claim 9, wherein the abrasion prevention plate and the yoke are made of different materials.

* * * * *